United States Patent [19]

Grimard

[11] Patent Number: 4,976,607

[45] Date of Patent: Dec. 11, 1990

[54] BURNER APPARATUS FOR PROVIDING ADJUSTABLE FLAME GEOMETRY

[75] Inventor: Francois X. Grimard, Quebec, Canada

[73] Assignee: Fuel Tech, Inc., Stamford, Conn.

[21] Appl. No.: 883,711

[22] Filed: Jul. 9, 1986

[51] Int. Cl.[5] ..... F23C 5/00

[52] U.S. Cl. ..... 431/174; 431/284; 431/187; 239/422; 239/424; 239/428

[58] Field of Search ..... 431/174, 175, 284, 285, 431/177, 178; 239/422, 428, 424

[56] References Cited

U.S. PATENT DOCUMENTS

| | | | |
|---|---|---|---|
| 1,400,657 | 12/1921 | Brodie | 239/422 |
| 1,702,298 | 2/1929 | Hetsch | 431/284 |
| 2,368,178 | 1/1945 | Turpin | 431/284 |
| 3,671,172 | 6/1972 | Chedaille et al. | 431/284 |
| 3,700,376 | 10/1972 | Niepemberg et al. | 431/188 |
| 4,095,929 | 6/1978 | McCartney | 239/424 |
| 4,447,010 | 5/1984 | Maeda et al. | 239/428 |
| 4,602,571 | 7/1986 | Chadshay | 239/422 |

FOREIGN PATENT DOCUMENTS

| | | | |
|---|---|---|---|
| 1038718 | 8/1983 | U.S.S.R. | 431/175 |

*Primary Examiner*—Carroll B. Dority

*Attorney, Agent, or Firm*—St. Onge Steward Johnston & Reens

[57] ABSTRACT

A burner apparatus having particular advantage for use with rotary kilns of the type used to process cement, lime, and the like, provides adjustable flame geometry and location within the combustion zone. Either gaseous or liquid fuels can be fired with highly selective heat flux as required for processing. Air and gaseous fuel injection means are controllable to vary the velocity of injection and thereby alter flame geometry. This is achieved by disposing an axially-adjustable control baffle in a crossectional area of changing transition section formed by coaxial members, between which an air supply conduit is formed. The control baffle is cylindrical and fits in and moves within the air supply conduit. The transition section has frustoconical surfaces opposite frustoconical surfaces on the control baffle so that different gaseous mass flow can be regulated around a central flame resulting in an adjustable flame geometry.

6 Claims, 8 Drawing Sheets

BURNER APPARTAUS FOR PROVIDING ADJUSTABLE FLAME GEOMETRY

TECHNICAL FIELD

The invention relates to burner apparatus, and more particularly to a burner apparatus which provides a stable flame over a wide range of heat outputs with adjustable flame geometry.

There are a number of applications, such as in firing rotary kilns of the type employed for the treatment of cement, lime, metal oxides, metal ores, and the like, for which it is desirable to have a burner that is capable of adjusting not only the heat output but also the geometry and position of the flame within the kiln or other combustion zone.

SUMMARY OF THE INVENTION

The invention provides a burner apparatus capable of supplying air and gaseous or liquid carbonaceous fuel to a combustion zone, such as within a rotary kiln, to enable adjustment of the geometry and location of the flame within the combustion zone. In one broad aspect, the apparatus comprises: (a) means for injecting air into said zone at a selectable air velocity; and (b) at least one of (i) means for atomizing liquid fuels into said zone at one or more of a plurality of selectable spray angles, or (ii) means for injecting gaseous fuels into said zone at a selectable gas velocity.

Preferably, the apparatus will have the means for injecting air positioned concentrically about the means for injecting gaseous fuels, and the means for injecting gaseous fuels will be concentrically positioned about the means for atomizing liquid fuels.

According to one preferred embodiment, the means for injecting air will include means defining concentrically disposed inner and outer air channels comprising: an outer tubular member comprising an elongated cylindrical portion terminating at the end nearest the combustion zone by a frustoconical section joined to a cylindrical member of smaller diameter and shorter length than said elongated cylindrical portion; and a flow control baffle concentrically disposed and axially moveable within said outer tubular member, the space between said outer tubular member and said baffle defining said outer air channel and the space between said baffle and said means for injecting gaseous fuels defining said inner air channel. Preferably, the flow control baffle comprises a tubular frustoconical member axially moveable toward and away from the inner surface of said frustoconical section of said outer tubular member, said movement varying the cross section of said outer air channel. The apparatus also preferably includes means for axially moving said baffle within said outer tubular member.

Similarly with the air injection means, the preferred means for injecting gaseous fuels includes inner and outer wall means defining an annular gaseous fuel channel, and means for varying the cross section of said annular channel at the end nearest the combustion zone. According to the preferred embodiment, the means for varying the cross section of said annular channel comprises a frustoconical surface on said outer wall means, and a complementary frustoconical surface on said inner wall means, said complementary frustoconical surface being concentrically positioned with and axially moveable relative to said frustoconical surface on said outer wall means. The burner preferably further includes means for imparting said axial movement. The burner apparatus will preferably also include a plurality of flame stabilizing gas jets positioned radially of said annular channel at said end nearest the combustion zone.

The preferred means for atomizing liquid fuels comprises: a plurality of concentrically-positioned liquid fuel supply channels, each supplying one of a plurality of spray plates having a defined spray pattern; and means for controlling the flow of said fuel to each of said liquid fuel supply channels. Preferably, the individual spray plates are designed to produce substantially the same fuel droplet size for a given fuel supply pressure.

BRIEF DESCRIPTION OF THE DRAWINGS

The invention will be better understood and its advantages will become more apparent when the following detailed description is read in conjunction with the accompanying drawings, wherein.

DETAILED DESCRIPTION

The burner apparatus of the present invention has utility in all situations where adjustability of flame geometry is important, but will be described herein with specific reference to providing heat to rotary kiln apparatus wherein the flame extends horizontally into the cylindrical kiln. The burner apparatus is capable of firing either gaseous or liquid hydrocarbon fuels to provide an adjustable heat flux with low primary air adjustability and high flame stability. The burner apparatus can include either gaseous fuel or liquid fuel supply means, or both in combination for greatest flexibility in operation.

Figure 1:
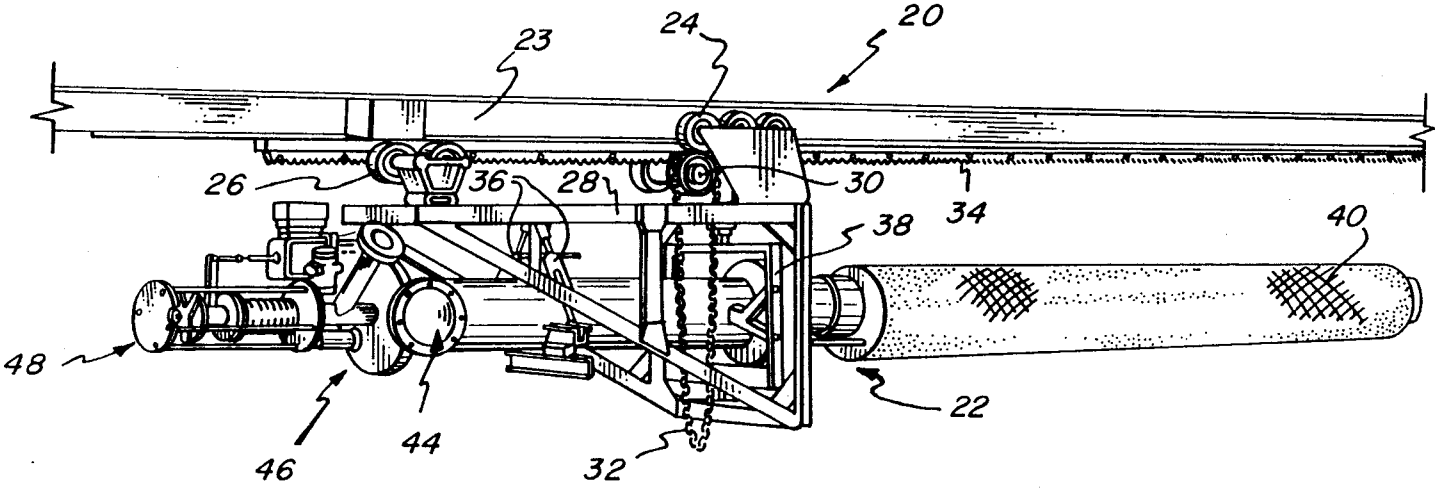
FIG. 1 is a perspective view of a preferred form of burner apparatus according to the invention including means enabling axial and radial positioning within a combustion zone, such as within a rotary kiln.
Figure 6:
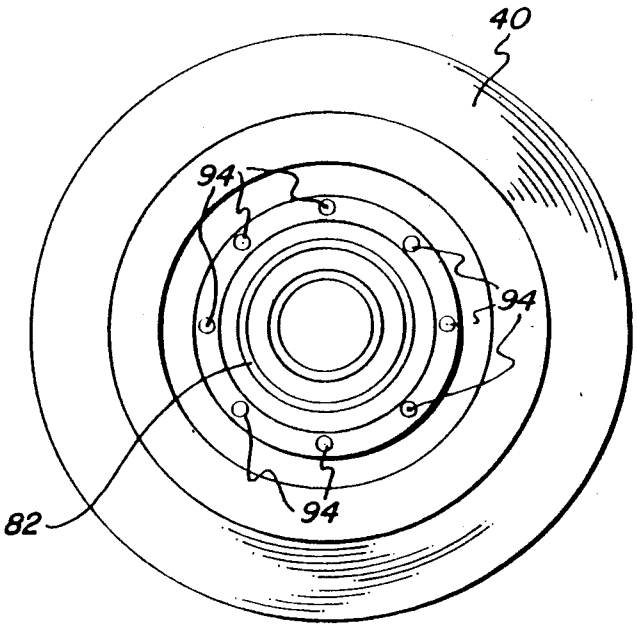
FIG. 6 is a front elevation of the burner shown in FIG. 1 showing the arrangement of air, gaseous fuel and liquid fuel discharge openings.
Figure 13:
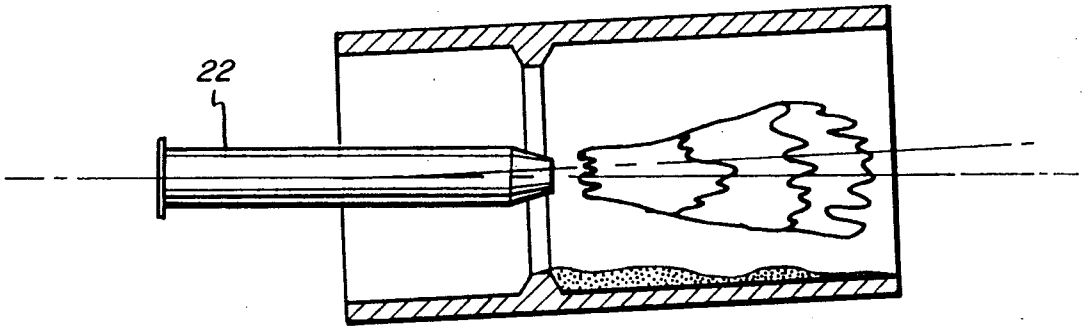
FIG. 13 is a schematic representation of a burner apparatus according to the invention positioned within a rotary kiln.

FIG. 1 is a perspective view of a burner apparatus of the invention, capable of operating with gaseous or liquid fuels, shown generally as 20. The burner assembly 22 is shown suspended in a horizontal position from support rail 23 for movement along it, generally axially within a kiln or other combustion zone. See FIG. 13. Front casters 24 and rear casters 26 permit burner carriage 28 to move smoothly along support rail 23. Driving mechanism 30 is operated by pulling chain 32 to rotate gear drive means (not shown), which in turn engage gear track 34 on support rail 23 to provide positive positioning. Affixed to carriage 28 and the burner assembly are turnbuckles 36 which, by virtue of their angular relationship to both the carriage 28 and the burner subassembly 22, can be used to vary both the vertical pitch and the horizontal yaw of the assembly 22. This movement is further facilitated by pivotable frame 38 supported in universal arrangement by horizontal and vertical pivots.

The front end of the burner assembly 22, i.e., the end nearest the combustion zone, is covered with a ceramic or other insulating material 40. As can be seen from the sectional view of FIG. 2, insulating material 40 covers the front end of outer tubular member 42. As can be seen from FIG. 1, the rear end of outer tubular member 42 is free of insulation and in communication with port 44 through which air is supplied to the burner. Shown generally at 46 are control means associated with gaseous fuel injection means. Shown generally at 48 are control means associated with liquid fuel atomizing means.

Figure 9:
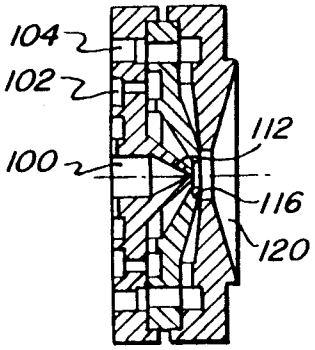
FIG. 9 PRIOR ART
FIG. 9 is a cross sectional view of the front end, also along the long axis, of the liquid fuel atomizing means showing detail of the sprayer plates.
Figure 8:
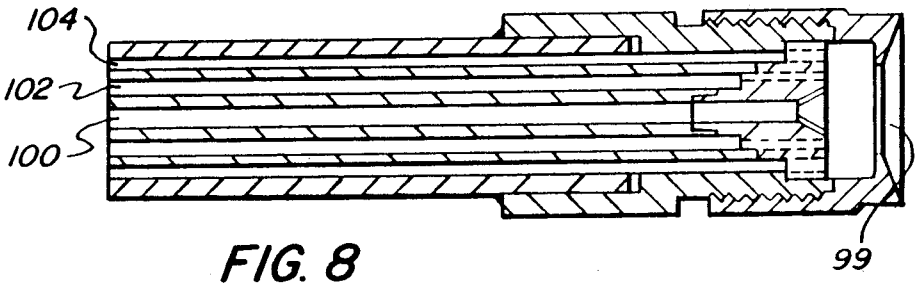
FIG. 8 PRIOR ART
FIG. 8 is a cross sectional view taken along the long axis of the liquid fuel atomizing means.
Figure 7:
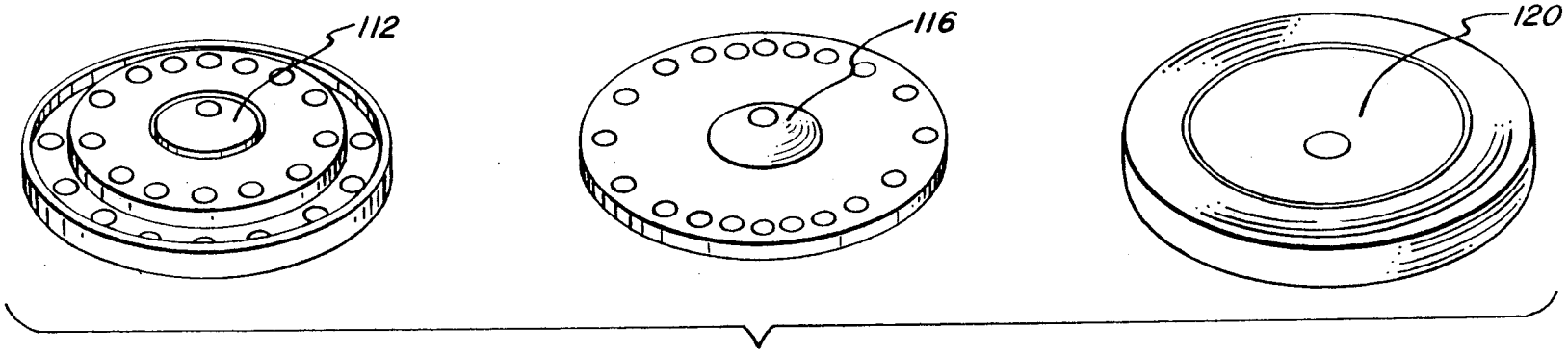
FIG. 7 PRIOR ART
FIG. 7 shows the detail of a preferred series of sprayer plates for liquid fuel atomization.

As will be explained in greater detail, the burner assembly 22, shown in perspective in FIG. 1 and in partial section in FIG. 2, includes three concentrically-positioned feeding means. The outer-most is a means for injecting air into the combustion zone at a selectable air velocity. This is defined concentrically by the inner surface of outer tubular member 42 and the outer surface of wall 50. The middle feeding means is a means for injecting gaseous fuel into the combustion zone at a selectable gas velocity. This is defined concentrically by the inner surface of tubular wall 50 and the outer surface of tubular wall 52. Finally, the inner-most feeding means, shown generally as 54 (see FIGS. 7, 8 and 9 for detail), is for atomizing liquid fuels into the combustion zone at one or more of a plurality of spray angles.

The space between outer tubular member 42 and tubular wall 50 confines and directs air from the supply at to the area of injection into the combustion zone. At the end of the burner assembly nearest the combustion zone (the front end, shown to the right in the drawing), the elongated cylindrical portion of the outer tubular member 42 terminates in a frustoconical section 56 joined to a cylindrical member 58 of smaller diameter and shorter length than the elongated cylindrical portion of member 42. A flow control baffle 60 is concentrically disposed and axially moveable within member 42. The space between tubular member 42 and baffle 60 defines an outer air channel 62. The space between wall 50 and baffle 60 defines an inner air channel 64.

Flow control baffle 60 includes a frustoconical portion 66 and is axially moveable within member 42 such that frustoconical portion 66 can be moved toward and away from the inner surface of the frustoconical section 56 of member 42. This movement tends to mate the complementary frustoconical surfaces and enables variation of the cross section of the outer air channel, thereby enabling variation of the air velocity therefrom to a selectable value. It will be understood that it is possible to employ shapes other than complementary frustoconical sections which also have the ability to restrict the flow of air, as here, or gaseous fuel, as will be described later.

Figure 3:
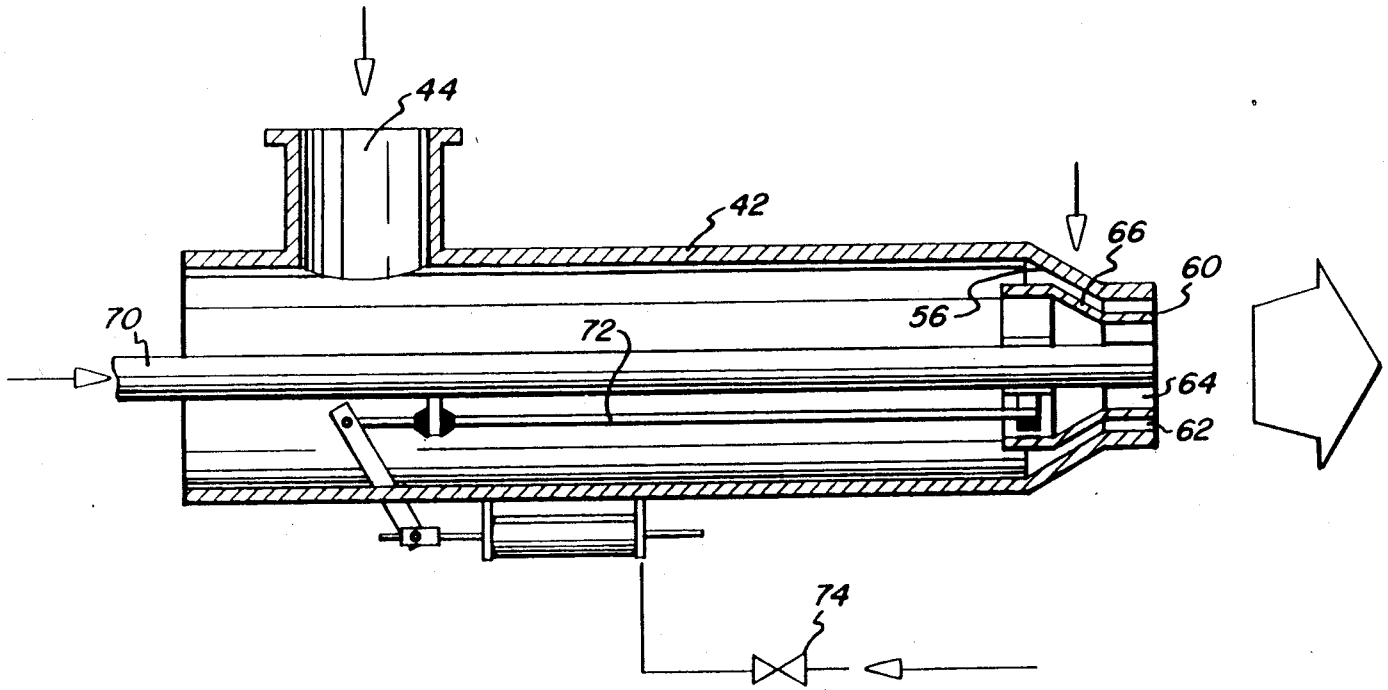
FIG. 3 is a schematic representation of a preferred air injection system.

FIG. 3 schematically shows a preferred manner of operating the air injection system described above. For a given type of kiln and process, the quantity and velocity of the air, i.e., the main criteria of primary air, to the combustion zone are defined based on known considerations. The present invention provides for deviation through primary air impulse control that, for a constant mass flow rate, permits the velocity to be increased or decreased to vary flame geometry and thereby heat flux as required. With air being supplied through port 44 and fuel being supplied through port 70, both at constant mass flow rates, the flame geometry can be varied by on the order of 25% of its length.

Figure 10A:
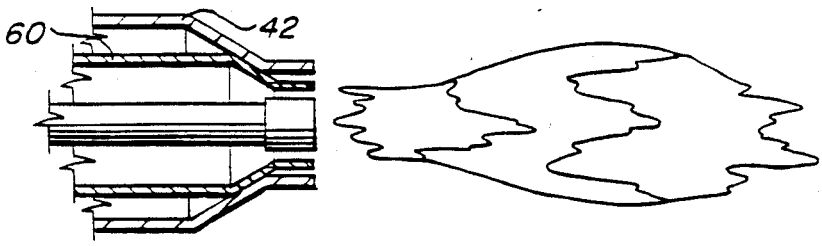
FIGS. 10A and 10B are schematic representations of the variability of flame geometry by control of air injection as per FIG. 3.
Figure 10B:
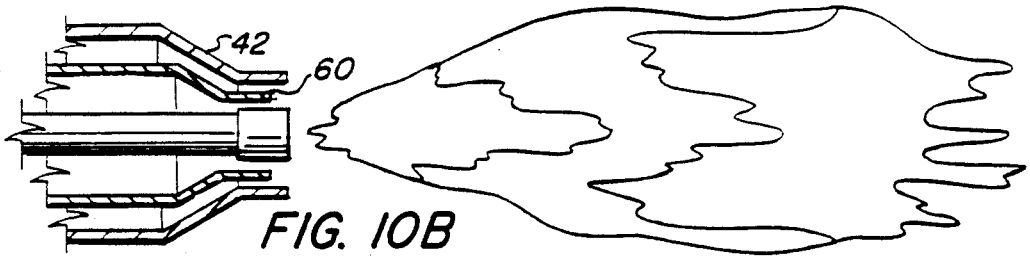

With the baffle 60 withdrawn such that outer air channel 62 has its maximum cross section, the length of the flame will be at its maximum. This can be seen in the lower diagram in FIG. 10. By moving baffle 60 to its full forward position such that a minimal cross section of channel 62 is achieved, the flame can be decreased to about 75% of its original length. This can be seen in the upper diagram in FIG. 10. Stops in the form of ribs, or the like, on either the baffle 60 or section 56, can be employed to prevent complete closure of outer channel 62. The baffle is moved by control rod 72 which is moved in response to an automatic controller 74 or a manually operated control means.

Referring again to FIG. 2, the means for injecting gaseous fuels into the combustion zone is shown to include an annular gaseous fuel channel 80 which conveys gas from its source of supply (not shown) to its discharge through annular orifice 82 at the end of the burner near the combustion zone. Channel 80 is defined by inner and outer wall means, namely tubular members 50 and 52, respectively.

Affixed to the front-most portion of tubular member 52 nearest combustion zone is a variable gas orifice restrictor 84 which, in cooperation with gas power calibration orifice 86, defines the cross section of the orifice and thereby, for a constant mass flow rate of gaseous fuel, the velocity of the fuel injected into the combustion zone. Calibration orifice 86 includes a frustoconical, inner, inwardly tapering section 88, and the orifice restrictor 84 has a complementary frustoconical surface 90. By moving tubular member 52 axially within tubular member 50 it is possible to vary the size of annular orifice 82 to achieve a selectable gaseous fuel injection velocity.

Figure 4:
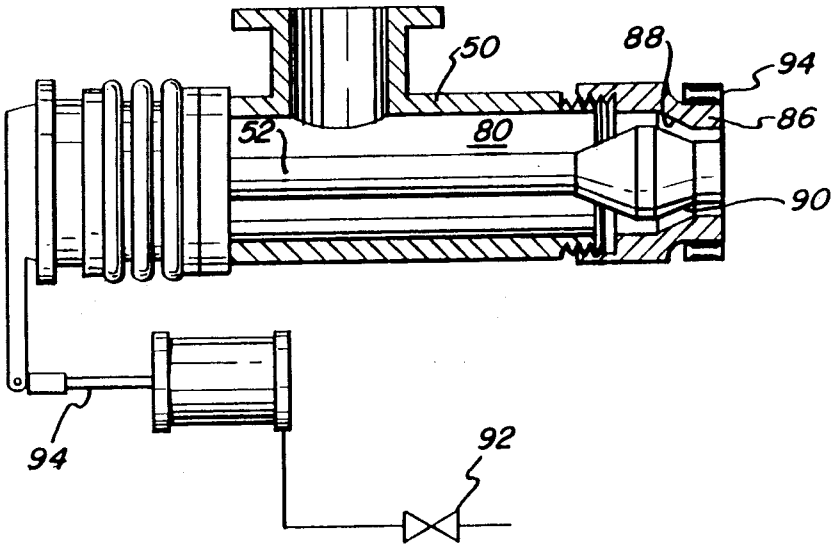
FIG. 4 is a schematic representation of a preferred gaseous fuel injection system.

FIG. 4 schematically shows a preferred gaseous fuel injection system which can include automatic controls such as shown at 92 or similarly-functioning manual controls. Operation of push rod 94 which is mechanically linked to tubular member 52 causes the described movement of frustoconical surface 90 with respect to the complementary surface 88.

Figure 11A:
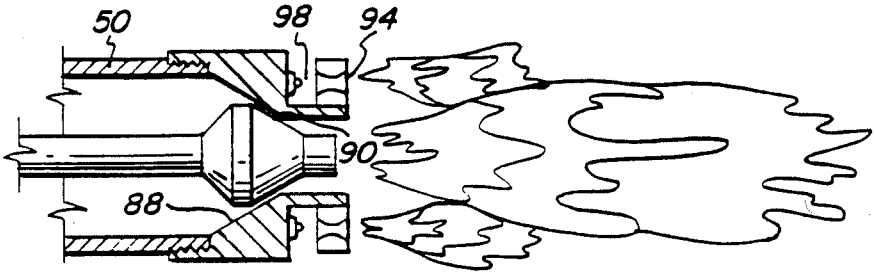
FIGS 11A and 11B are schematic representations of the variability of flame geometry by control of gaseous fuel injection as per FIG. 4.
Figure 11B:
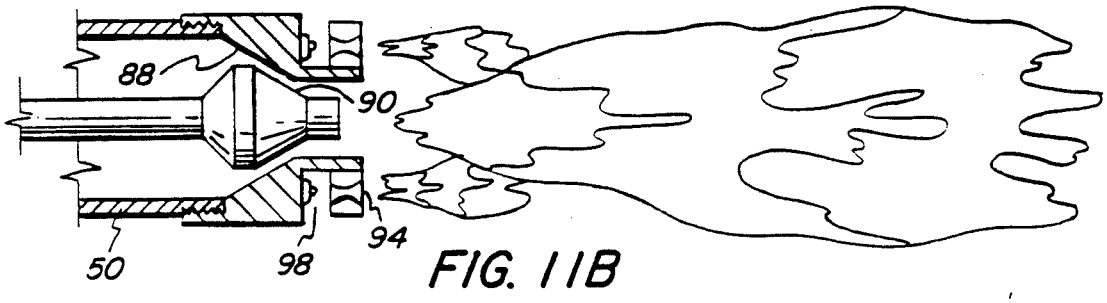

By positioning the member 52 in the full open position where maximum flame length is obtained at constant gas flow rates for both gaseous fuel and air, the flame geometry and heat flux will be suitable for certain situations, but less desirable for others. This is seen in the lower view in FIG. 11. By advancing tubular member 52 and thereby bringing complementary frustoconical portions 88 and 90 into closer engagement (upper view in FIG. 11), it is possible to reduce the length of flame to about 75% of its original length, thereby enabling process flexibility to obtain optimum conditions for other circumstances.

The flame produced under either of the noted extreme sets of conditions or any intermediate one is highly stable according to the preferred embodiment of the invention wherein a plurality (e.g., eight) of flame stabilizing jets 94 are positioned radially of the annular channel 82. As can be seen in FIG. 2, a portion of the gaseous fuel is fed to these flame stabilizing jets via line 96, with air being drawn as needed through opening 98.

The means for atomizing liquid fuels into the combustion zone will preferably be of the type which includes a plurality of concentrically-positioned liquid fuel supply channels, each supplying one of a plurality of spray plates at discharge point 99 having a defined spray pattern, and means for controlling the flow of fuel to each of a liquid fuel supply channels. The individual spray plates in fuel atomizing units of this type are designed to produce substantially the same fuel droplet size for a given fuel supply pressure.

Figure 5:
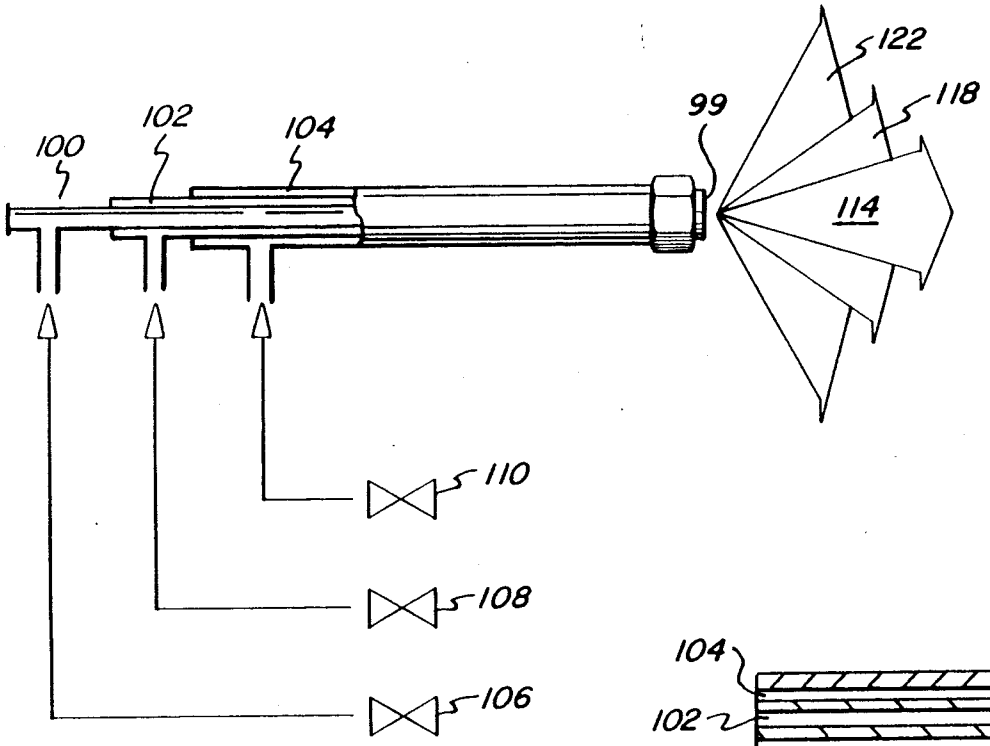
FIG. 5 PRIOR ART
FIG. 5 is a schematic representation of a preferred oil atomization system.

FIG. 5 is a schematic representation of a liquid fuel atomizing system which can be employed according to the present invention. As shown in drawing, three concentric channels 100, 102 and 104 are independently fed via controllers 106, 108 and 110, respectively. Burners of this type are described in NAVSEA 0951-LP-038-6010, pages F-1 through F-7.

Figure 12A:
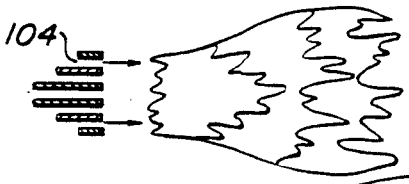
FIGS. 12A, 12B and 12C are schematic representations of the variability of flame geometry by control of liquid fuel atomization as per FIG. 5.
Figure 12B:
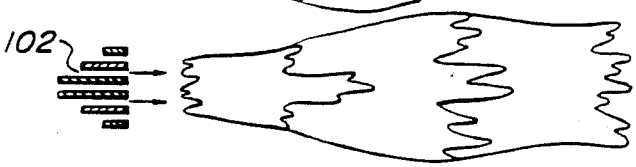
Figure 12C:
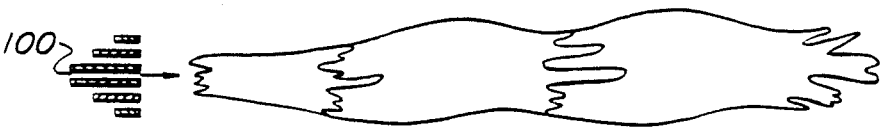

Preferably, each of a plurality, e.g., three, sprayer plates (see FIGS. 7 and 9) is designed for identical fuel droplet size and throughput at a given fuel supply pressure. The individual oil sprays provide the ability to select a desired spray angle. The center sprayer plate has a long exit port 112 to produce a small hollow cone 114 of atomized oil or other liquid fuel. The intermediate sprayer plate 116 has a shorter exit port length to produce a more opened hollow cone spray 118. The outer sprayer plate has a short exit port length to provide a wide angle hollow cone of atomized liquid fuel. The fuel flow to each sprayer plate is controlled through independent fuel circuit and flow control valves as described above to enable the maximum variation of geometry of the flame. The proper control of the liquid atomizing system will permit up to about 50% adjustment flexibility in the length of the flame. This can be seen in FIG. 12.

Figure 2:
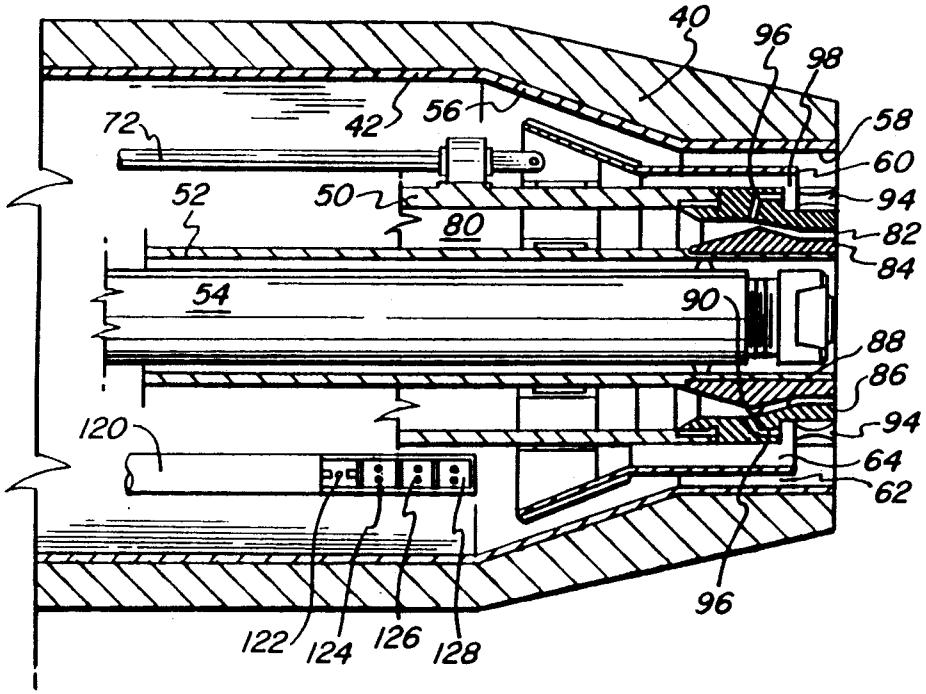
FIG. 2 is a partial cross section of the burner apparatus showing the interior thereof at the end closest to the combustion zone.

Also seen in FIG. 2 is igniter means 120 located within the air supply channel. Igniter 120 has a gaseous fuel supply and an electric igniter. As gas is supplied to the first and subsequent of tub-like openings 122, 124, 126 and 128, its ignition in the presence of air causes a cascading of flame across the length of the igniter and then out into the combustion zone where the principal combustion is effected.

The above description is for the purpose of teaching those skilled in the art how to practice the present invention. It is not intended to teach all of the obvious modifications and variations of the invention. It is intended, however, that all such modifications and variations of the invention be included within the scope of the invention which is defined by the following claims.

I claim:

1. A burner such as for use in a rotary kiln or the like and capable of supplying air and gaseous or liquid fuel along a burner axis from an end of the burner to a flame in a combustion zone, comprising:

first and second hollow members, said first member surrounding the other, said members being sized to form an air supply conduit therebetween which terminates at the burner end, said second member being sized to provide fuel to said zone;

one of the hollow members having first and second portions with respectively differently sized cross sections and with a transition section therebetween;

a flow control baffle disposed within the air supply conduit opposite the transition section and having a front segment that extends forwardly between the first and second hollow members to separate the air supply conduit into inner and outer air channels that are open towards said combustion zone;

said flow control baffle being mounted to move axially so as to control air flow through the air channel that borders the transition section and correspondingly adjust the burner flame wherein the cross section of said air channels comprises frustoconical surfaces on said transition section and a complementary frustoconical surface on said flow control baffle, said complementary frustoconical surface being coaxially-positioned with and axially-movable relative to said frustoconical surface on said transition section;

means for imparting said axial movement to the flow control baffle;

and a plurality of flame stabilizing gas jets positioned radially of said channels at said burner end nearest the combustion zone.

2. A burner such as for use in a rotary kiln or the like and capable of supplying air and gaseous or liquid fuel along a burner axis from an end of the burner to a flame in a combustion zone, comprising:

first and second hollow members, said first member surrounding the other, said members being sized to form an air supply conduit therebetween which terminates at the burner end, said second member being sized to provide fuel to said zone;

one of the hollow members having first and second portions with respectively differently sized cross sections and with a transition section therebetween;

a flow control baffle disposed within the air supply conduit opposite the transition section and having a front segment that extends forwardly between the first and second hollow members to separate the air supply conduit into inner and outer air channels that are open towards said combustion zone;

said flow control baffle being mounted to move axially so as to control air flow through the air channel that borders the transition section and correspondingly adjust the burner flame;

a plurality of concentrically-positioned liquid fuel supply channels, each supplying one of a plurality of spray plates having a defined spray pattern; and means for controlling the flow of said fuel to each of said liquid fuel supply channels.

3. A burner apparatus capable of supplying air and gaseous or liquid carbonaceous fuels to a combustion zone, comprising:

means for injecting air into said zone at a selectable air velocity;

means for injecting atomizing liquid fuels into said zone at one or more of a plurality of selectable spray angles; and means for injecting gaseous fuels into said zone at a selectable gas velocity wherein said means for injecting air is coaxially positioned about said means for injecting gaseous fuels and said means for injecting gaseous fuels is coaxially-positioned about said means for atomizing liquid fuels;

wherein said means for injecting gaseous fuels comprises inner and outer wall means defining an annular gaseous fuel channel, and means for varying the cross section of said annular channel towards the combustion zone, said latter means further comprising a frustoconical surface on said outer wall means, and a complementary frustoconical surface on said inner wall means, said complementary frustoconical surface being coaxially positioned with and mounted for axial motion relative to said frustoconical surface on said outer wall means, and means for imparting said axial motion to the inner wall means.

4. A burner apparatus according to claim 3 which further includes a plurality of flame stabilizing gas jets positioned radially of said annular channel at said end nearest the combustion zone.

5. A burner apparatus capable of supplying air and gaseous or liquid carbonaceous fuels to a combustion zone, comprising:

means for injecting air into said zone at a selectable air velocity;

means for injecting atomizing liquid fuels into said zone at one or more of a plurality of selectable spray angles; and means for injecting gaseous fuels into said zone at a selectable gas velocity wherein said means for injecting air is coaxially positioned about said means for injecting gaseous fuels is coaxially-positioned about said means for atomizing liquid fuels;

wherein said means for atomizing liquid fuels comprises: a plurality of coaxially-positioned liquid fuel supply channels, a plurality of spray plates each having a defined spray pattern with a said fuel supply channel coupled to supply liquid fuel to each spray plate; and means for controlling the flow and said fuel to each of said liquid fuel supply channels.

6. A burner apparatus according to claim 5 wherein the individual spray plates have apertures sized to produce substantially the same fuel droplet size for a given fuel supply pressure.

* * * * *